US006076506A

United States Patent [19]

Berlinger et al.

[11] Patent Number: 6,076,506

[45] Date of Patent: Jun. 20, 2000

[54] PISTON FOR USE IN AN ENGINE

[75] Inventors: Willibald G. Berlinger, Peoria; T. Pin P. Shyu, Dunlap; John M. Sloma, Lacon, all of Ill.

[73] Assignee: Caterpillar Inc., Peoria, Ill.

[21] Appl. No.: 09/082,135

[22] Filed: May 20, 1998

[51] Int. Cl.[7] ..... F04B 17/00

[52] U.S. Cl. ..... 123/465 C; 123/193.6

[58] Field of Search ..... 123/46 R, 46 C, 123/193.6; 92/191, 220, 221

[56] References Cited

U.S. PATENT DOCUMENTS

| | | | |
|---|---|---|---|
| 4,751,871 | 6/1988 | Burghardt et al. | 92/221 |
| 4,791,786 | 12/1988 | Stuyvenberg . | |
| 4,829,954 | 5/1989 | Morgado | 123/193.61 |
| 5,022,313 | 6/1991 | Shontz et al. . | |
| 5,482,445 | 1/1996 | Achten et al. . | |
| 5,540,193 | 7/1996 | Achten et al. | 123/46 SC |
| 5,680,980 | 10/1997 | Robinson | 123/46 SC |
| 5,724,933 | 3/1998 | Silvonen et al. | 123/193.6 |

FOREIGN PATENT DOCUMENTS

| | | |
|---|---|---|
| 61085558 | 5/1986 | European Pat. Off. . |
| 2069326 | 9/1971 | France . |
| 2630004A1 | 1/1978 | Germany . |
| 3218320A1 | 11/1983 | Germany . |

*Primary Examiner*—Marguerite McMahon
*Attorney, Agent, or Firm*—J. W. Burrows

[57] ABSTRACT

A piston is provided for use in a free-piston engine and includes a crown portion having a predetermined thickness, a plunger connection portion having a passage extending therethrough along the axis of the piston and being connected to the crown portion, a sealing portion extending from the crown portion, and a strut portion having a plurality of struts disposed between the sealing portion and the plunger connection portion. The piston of the subject invention provides a compact, high strength, low weight design that is effective in use to provide efficient operation and effectively conduct heat from the piston during use.

26 Claims, 4 Drawing Sheets

PISTON FOR USE IN AN ENGINE

TECHNICAL FIELD

This invention relates generally to a piston adapted for use in an engine and more particularly to the structure of a piston used in a free-piston engine.

BACKGROUND ART

Known pistons have many different shapes and configurations. In order to minimize the weight of the known pistons, they are normally made of aluminum. Other known piston assemblies may have portions made of steel and other portions made of aluminum. Likewise there are pistons assemblies made of two different parts and secured together by bolts or pins.

The pistons used in typical engines having crankshafts require a mass of material to permit the connection of the connecting rod to the piston. This mass of material not only adds weight but it also adds to the length of the piston. When using aluminum pistons, the heat that is induced into the piston during combustion is quickly conducted away by using water cooling jackets surrounding the chamber that the piston moves within.

DISCLOSURE OF THE INVENTION

In one aspect of the subject invention, a piston defining a reference axis is provided for use in a free-piston engine and includes a crown portion having a combustion surface and a predetermined wall thickness extending from the combustion surface and being located at one end of the piston. A plunger connection portion is connected to the crown portion and has a passage defined therein along the reference axis and also includes an end surface spaced from the crown portion. The plunger connection portion is oriented along the reference axis and the passage extends through the piston from the combustion surface to the end surface of the plunger connection portion. A sealing portion has a cylindrical surface with a predetermined diameter and extends parallel with the reference axis. A gallery is defined by at least portions of the crown portion, the plunger connection portion and the sealing portion. The piston further includes a skirt portion having a cylindrical surface with a predetermined diameter that is substantially the same as the predetermined diameter of the cylindrical surface of the sealing portion. A strut portion is provided and has a plurality of struts disposed in the gallery portion between the plunger connection portion and the sealing portion.

BEST MODE FOR CARRYING OUT THE INVENTION

Figure 1:
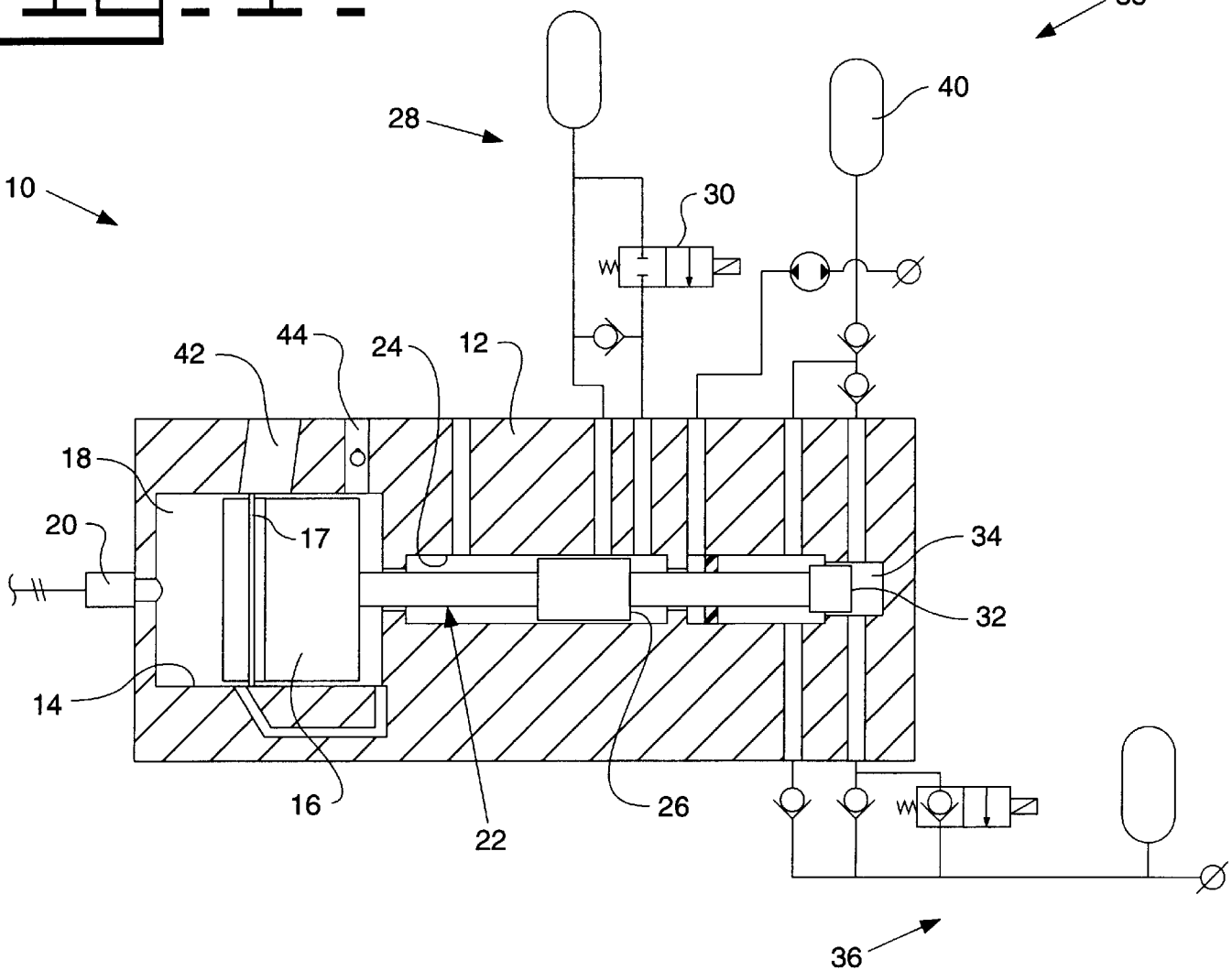
FIG. 1 is a part schematic and a part diagrammatic illustration of a free-piston engine incorporating an embodiment of the subject invention.
Figure 2:
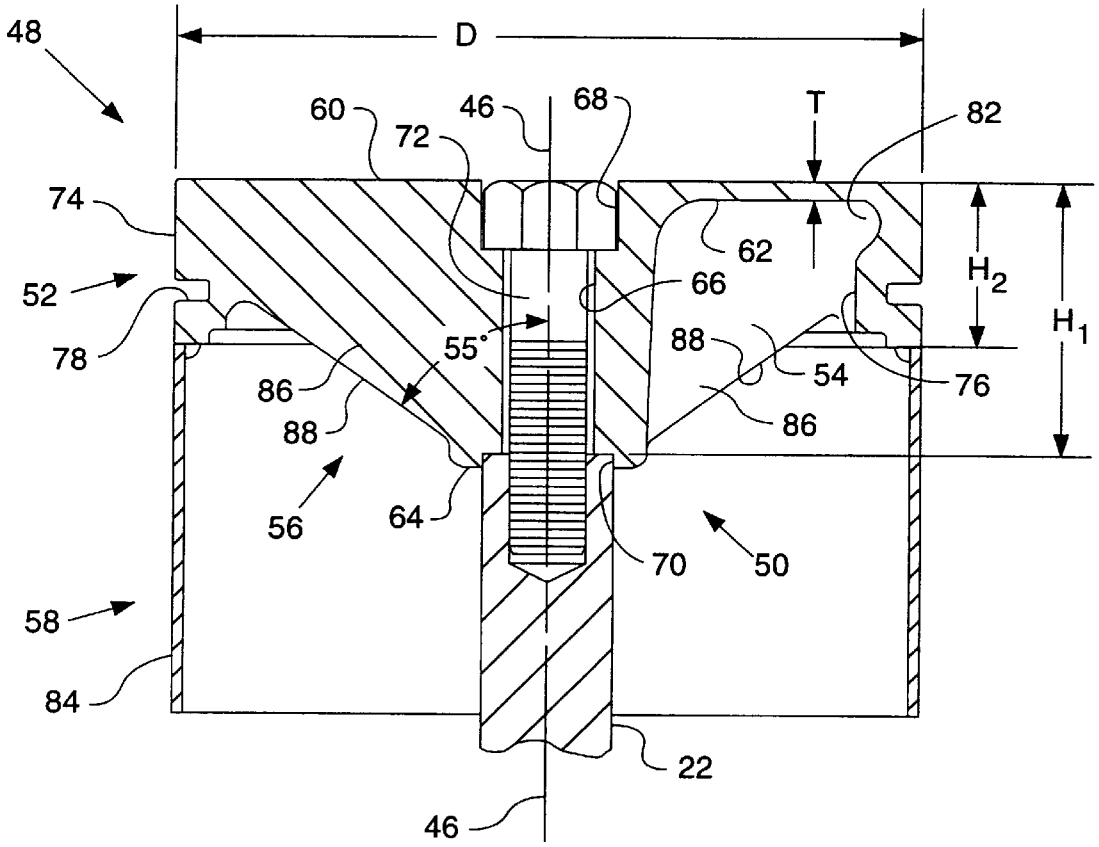
FIG. 2 is a sectional view of the piston from FIG. 1.
Figure 3:
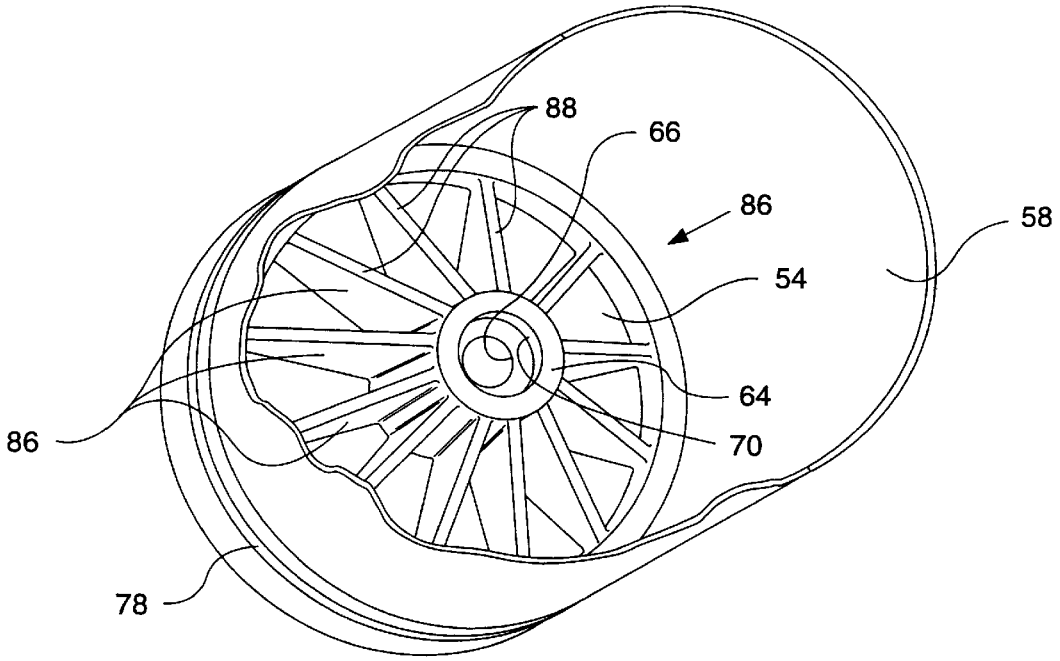
FIG. 3 is an isometric view of the underside of the piston of FIG. 2 with a large portion of the skirt removed.

Referring to the drawings, and more particularly to FIGS. 1–3, a free-piston engine 10 is diagrammatically illustrated and includes a housing 12 defining bore 14 having a piston 16 slideably disposed therein. The piston 16 as is well known has a seal ring 17. A combustion chamber 18 is defined between one end of the bore 14 and the piston 16. A fuel injector mechanism 20 is attached to the housing 12 and operative to selectively inject fuel into the combustion chamber 18.

A plunger 22 is connected to the piston 16 at the end thereof opposite to the combustion chamber 18 and slideably disposed in a first bore 24. The plunger 22 has a first pressure responsive shoulder 26 disposed thereon and the shoulder is in selective communication with a source of pressurized fluid 28 through a control valve 30. The plunger 22 has a force transferring surface 32 at the end thereof opposite to the point of connection with the piston 16. The force transferring surface is disposed in a fluid chamber 34 defined in the housing 12. The fluid chamber 34 is in selective communication with a reservoir or low pressure source 36 and also in selective communication with a pressure storage or work system 38. The pressure storage or work system 38 may include one or more accumulators 40 and/or actuators in the work system.

The housing 12 includes exhaust ports 42 and air inlet ports 44 in communication with the bore 14. For additional details of a typical free-piston engine 10, see U.S. Pat. No. 5,482,445 assigned to Innas Free Piston B.V.

Referring to FIGS. 2 and 3, the piston 16 is more clearly illustrated and defines a reference axis 46. The piston 16 includes a crown portion 48, a plunger connection portion 50, a sealing portion 52, gallery 54, strut portion 56, and a skirt portion 58. The crown portion 48 has a combustion surface 60 on one side thereof at the end of the piston 16 and a cooling surface 62 on the opposite side thereof. The crown portion 48 has a predetermined thickness "T".

The plunger connection portion 50 is connected to the crown portion 48 and extends in a direction away from the crown portion 48. The plunger connection portion 50 is oriented along the reference axis 46 and has an end surface 64 disposed thereon spaced from the crown portion. A passage 66 is defined in the plunger connection portion 50 and extends therethrough along the reference axis 46. In the subject embodiment, the passage 66 also extends through the crown portion 48. A first counterbore 68 is defined concentric with the passage 66 and extends from the combustion surface 60 into the plunger connection portion 50 a predetermined distance. A second counterbore 70 is defined concentric with the passage 66 and extends from the end surface 64 into the plunger connection portion 50 a predetermined distance. A compression height "$H_1$" is defined between the bottom of the second counterbore 70 and the combustion surface 60. It is recognized that the second counterbore 70 could be omitted and the plunger 22 would then contact the end surface 64. Consequently, the compression height "$H_1$" would extend between the end surface 64 and the compression surface 60.

As illustrated in FIG. 2, a fastener, such as a bolt 72, is disposed in the passage 66 and threaded into the plunger 22 in a conventional manner to secure the piston 16 to the plunger 22. The head of the bolt 72 is disposed in the first counterbore 68 and one end of the plunger is disposed in the second counterbore 70. It is recognized that other types of fastening devices could be used in the subject arrangement to secure the piston 16 to the plunger 22. It is also envisioned that a protector cap (not shown) could be placed in the first counterbore 68 and secured therein to protect the fastener and also to more effectively prohibit combustion gases from passing therethrough.

The sealing portion 52 has a cylindrical surface 74 with a predetermined diameter "D" and an inner surface 76. The predetermined thickness "T" of the crown portion 48 is less than five percent of the predetermined diameter "D" of the sealing portion 52 and preferably less than three percent. The cylindrical surface 74 extends parallel with the reference axis 46 and in a direction away from the combustion surface 60 for a predetermined distance "$H_2$". The predetermined distance "$H_2$" of the sealing portion 52 is less than the predetermined distance "$H_1$" of the plunger connection portion 50. The compression height "$H_1$" is less than forty percent of the predetermined diameter "D" of the sealing portion 52 and preferably less than one-third thereof.

A ring groove 78 is defined in the sealing portion 52 spaced from the combustion surface 60. The ring groove 78 is operable in a known manner to receive the seal ring 17. It is recognized that when using some materials, the seal ring 17 and the ring groove 78 may not be needed. Close tolerances between the piston 16 and the bore 14 would be sufficient to seal the combustion gases.

The gallery 54 is defined in the piston by at least a portion of the crown portion 48, the plunger connection portion 50 and the sealing portion 52. The gallery 54 is an air cavity and permits air to be exposed to the piston 16 in order to dissipate heat away from the piston. A reentrant gallery 82 is defined in the piston 16 adjacent to the gallery 54 and is defined by the intersection of the crown portion 48 and the sealing portion 52.

The skirt portion 58 is secured to and extend from the sealing portion 52 parallel with the reference axis 46 and in a direction away from the combustion surface 60. The skirt portion 58 has a cylindrical surface 84 and the diameter thereof is substantially the same as the predetermined diameter "D" of the sealing portion 52. The skirt portion 58 is preferably formed from sheet metal but it is recognized that it could be made from other materials.

The strut portion 56 includes a plurality of struts 86 disposed in the gallery 54. Each of the struts 86 extend from the inner surface 76 of the sealing portion 52 towards the plunger connection portion 50. The plurality of struts are equally spaced from one another around the inner surface 76 of the sealing portion 52. The struts 86 serve two purposes. One is to provide maximum rigidity to resist combustion pressure force. The other is to provide maximum surface area to transfer heat of combustion to the air and/or to the plunger 22. On the other hand, the total weight of the strut portion 56 must be limited in order to minimize the total weight of the piston. Therefore, the total number of struts 86 and the thickness of each strut must be optimized to achieve those purposes discussed above. In general, the total surface area of the struts 86 should be at least 1.5 to 2 times the area of the combustion surface 60 in order to achieve sufficient cooling and also meet the weight limitation for the best engine performance, which is inversely proportional to the weight of the piston 16.

In the subject embodiment, each of the struts 86 have a surface 88 thereon located on the side thereof opposite to the cooling surface 62. The struts 86 are oriented perpendicular to the cooling surface 62. However, it is recognized that the struts may be at some angle other than perpendicular. Likewise, each of the struts 86 are connected to the cooling surface 62 and the plunger connection portion 50. Each strut 86 is connected such that the surface 88 is located generally adjacent the end surface 64 of the plunger connection portion 50 and the end of the skirt portion 52 opposed to the combustion surface 60.

The surface 88 of each of the struts 86 is angled with respect to the reference axis 46. The angle of the surface 88 with respect to the reference axis 46 is greater than fifty degrees and preferably about fifty-five degrees. The greater the number of struts 86 the more surface area that is exposed to the air in the gallery 54 to more effectively cool the piston 16.

Figure 4:
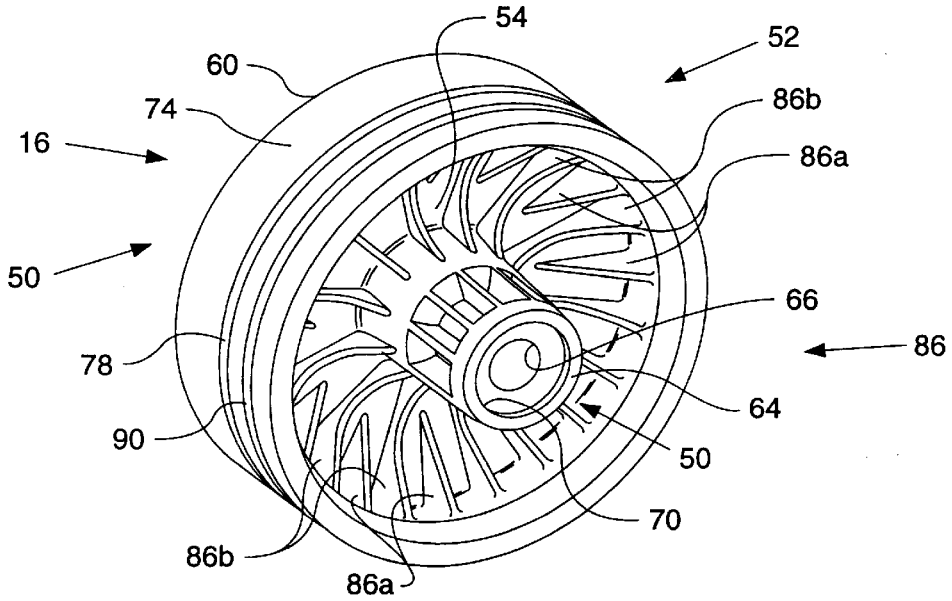
FIG. 4 is an isometric view of another embodiment of the piston from FIG. 1.

Referring to FIG. 4, another embodiment of the subject piston 16 is illustrated. Like element have like element numbers. In the piston 16 of FIG. 4, the skirt portion 56 has been removed for clarity. It is recognized that the skirt portion 56 is part of the piston 16 disclosed in FIG. 4.

A second ring groove 90 is defined in the skirt portion 52 of the embodiment of FIG. 4 and is generally adjacent to but spaced from the first ring groove 78. The second ring groove 90 is also operative in a known manner to receive a second seal ring (not shown).

A first portion **86*a* of the plurality of struts 86 is connected to the inner surface 76 of the skirt portion 52 and extends to and terminates at the cooling surface 62 of the crown portion 48. Each of the struts of the portion of struts 86*a* is connected with the cooling surface 62**.

A second portion **86*b* of the plurality of struts 86 is connected to the inner surface 76 of the skirt portion 52 and extends to and connected with the plunger connection portion 50. The second portion 86*b* of the struts is also connected to the cooling surface 62 of the crown portion 48. In the subject arrangement, the first and second portion 86*a*, 86*b* are arranged so that they are position one after the other. In the subject arrangement there is a greater number of struts and each of the struts 86*a*,86*b* are thinner than those illustrated in FIG. 3. Consequently, a greater surface area is exposed to the air for cooling without sacrificing the compression strength of the piston 16**.

Figure 5:
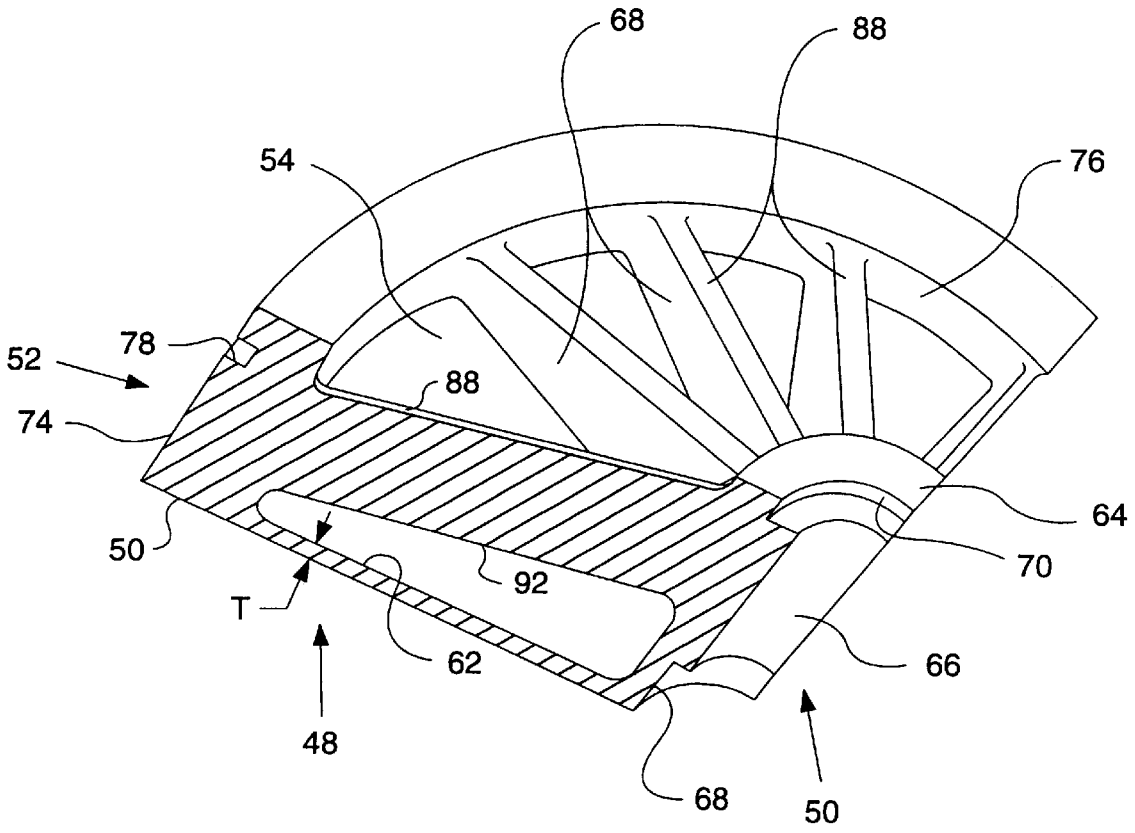
FIG. 5 is an isometric view of yet another embodiment of the piston from FIG. 1.

Referring to FIG. 5 yet another embodiment of the subject piston 16 is illustrated. As illustrated, only a quarter section is shown in order to more clearly set forth the differences. Like elements have like element numbers. The piston 16 of FIG. 5 is substantially the same as that set forth with respect to FIGS. 2 and 3. Consequently, only the differences will be set forth. Each of the struts 86 has a second surface 92 disposed thereon on the opposite side thereof adjacent to but spaced from the cooling surface 62 of the crown portion 48. Therefore, the struts 86 are not connected to the cooling surface 62. The space defined between the second surface 92 and the cooling surface 62 interconnects all portions of the gallery 54. By providing the space between the second surface 92 and the cooling surface 62, additional weight is removed.

It is recognized that either of the embodiments could have no ring grooves, one ring groove or two ring grooves with departing from the essence of the subject invention. Likewise, either of the embodiments could be modified to include any of the strut arrangements. In each of the embodiments, it is envisioned that the piston would be made from a steel material. One type of steel material would be, for example, an SAE 4140 steel. It is recognized that other steel types could be used. Likewise, any material possessing relatively high strength, strong thermal properties, and low thermal conductivity could be used in the subject piston 16 without departing from the essence of the subject invention. It is likewise envisioned that coating could be used on the combustion surface 50 to insulate the combustion surface 50 so that heat transfer therethrough is reduced and the surface protected from the heat and erosion. Even though the subject piston 48 is illustrated in a hydraulic type free-piston engine 10, it is recognized that the subject piston could be used in other types of engines, more particularly, other types of free-piston engines. Such as, for example, electric generating or gas compression types.

INDUSTRIAL APPLICABILITY

During operation of the free-piston engine 10, pressurized fluid is selectively directed through the control valve 30 from the source of pressurized fluid 28 and acts against the shoulder 26. The force of the pressurized fluid acting on the shoulder 26 moves the plunger 22 and connected piston 16 in a direction towards the fuel injector 20. Subsequent to the exhaust ports 42 being closed by the piston 16, fuel is injected into the combustion chamber 18. The mixture of air and fuel in the combustion chamber 18 is compressed to a point at which the mixture is caused to combust which initiates the expansion stroke of the piston 16. The compression forces reduces the velocity of the piston 16 as it nears the end of the combustion chamber 18. The force of the combustion forces the piston 16 to rapidly move in the opposite direction.

As the piston 16 moves in the compression direction, fluid from the reservoir or low pressure source fills the chamber 34. As the piston 16 and plunger 22 moves in the opposite direction, the fluid in the chamber 34 is compressed by the end 32 of the plunger 26 and forced into the pressure storage arrangement 38. The reaction force of the fluid in the chamber 34 being compressed slows the velocity of the piston 16 as it nears the end of the expansion stroke.

The compression and expansion strokes can be continually repeated in order to increase the level of pressurized fluid in the storage arrangement 38. Likewise, the frequency of the compression and expansion strokes can be selectively lowered or stopped as desired.

As the piston nears the end of the expansion stroke, the exhaust ports 42 are opened to allow exhaust gases to be vented. At the same time new air is permitted to enter the combustion chamber 18 through the air inlet ports 44.

The piston 16 must be able to withstand the forces subjected to it from the plunger 22 transferring its force resulting from the pressurized fluid acting on the shoulder 26 and the forces caused by the air/fuel mixture being compressed. The force from the plunger 22 is generally evenly transferred to the piston 16 through the plunger connection portion 50 and the strut portion 56. The forces caused by the compression of the air/fuel mixture is directed through the crown portion 48 to the plunger connection portion 50 and the strut portion 56. This arrangement permits a minimal amount of materials to withstand the forces and thus provides a piston that is strong and has a low mass. Likewise, by having the subject structure, the overall length of the piston 16 can be less. The overall length of the piston 16 is controlled, at least in part, by the compression height of the piston and the angle of the struts 86 with respect to the reference axis 46.

The struts 86 also provides extra surface area for exposure to the air for cooling of the piston. The use of the struts 86 also permits the thickness "T" of the crown portion 48 to be relatively thin. The heat from the combustion of the air/fuel mixture is more readily transmitted through the crown portion 48 into the gallery through the crown portion 48 and the respective struts 86. Additionally, the heat is transferred into the plunger 22 through the strut portion 56 and the plunger connection portion 50. The heat in the plunger 22 is transferred to other parts of the engine for cooling. The re-entrant gallery 82 reduces the heat transfer from the combustion surface 60 towards the skirt portion 58. Reducing the volume of heat transfer from the combustion chamber 18 to the sealing portion 52 reduces the tendency for the piston to scuff or score the bore 14 of the housing 12.

The piston 16 of each of the embodiments function in substantially the same way to provide high strength with less weight while also providing proper cooling to the piston. As previously note, the subject piston design reduces the overall length of the piston while maintaining the needed strength. Consequently, the overall length of the free-piston engine 10 can be shortened. The more compact the free-piston engine 10 is the less space needed in a machine for a given engine power size.

Other aspect, objects and advantages of the invention can be obtained from a study of the drawings, the disclosure and the appended claims.

We claim:

1. A piston defining a reference axis and being adapted for use in a free-piston engine, comprising:

a crown portion having a combustion surface and a predetermined wall thickness extending from the combustion surface and being located at one end of the piston;

a plunger connection portion connected to the crown portion and having a passage defined therein along the reference axis and an end surface spaced from the crown portion, the plunger connection portion being oriented along the reference axis and the passage extends through the piston from the combustion surface to the end surface of the plunger connection portion;

a sealing portion having a cylindrical surface with a predetermined diameter and extends parallel with the reference axis;

a gallery defined by at least portions of the crown portion, the plunger connection portion and the sealing portion;

a skirt portion having cylindrical surface with a predetermined diameter that is substantially the same as the predetermined diameter of the cylindrical surface of the sealing portion; and a strut portion having a plurality of struts disposed in the gallery portion between the plunger connection portion and the sealing portion.

2. The piston of claim 1 wherein the predetermined wall thickness of the crown portion is less than five percent of the predetermined diameter of the cylindrical surface of the sealing portion.

3. The piston of claim 2 wherein the predetermined wall thickness of the crown portion is less than three percent of the predetermined diameter of the cylindrical surface of the sealing portion.

4. The piston of claim 1 wherein a compression height is defined by the distance between the end surface of the plunger connector portion and the combustion surface and the compression height is less than forty percent of the predetermined diameter of the cylindrical surface of the sealing portion.

5. The piston of claim 4 wherein the compression height is less than one-third of the predetermined diameter of the cylindrical surface of the sealing portion.

6. The piston of claim 1 wherein the passage extending through the plunger connection portion and the crown portion has a counterbore defined therein extending inwardly for a predetermined distance from the combustion surface towards the end surface of the plunger connection portion.

7. The piston of claim 6 wherein the passage extending through the plunger connection portion has a second counterbore defined therein extending inwardly for a predetermined distance from the end surface of the plunger connection portion towards the combustion surface.

8. The piston of claim 1 wherein the sealing portion has a ring groove defined in its cylindrical surface spaced from the combustion surface.

9. The piston of claim 8 wherein the sealing portion has a second ring groove defined therein adjacent to the first ring groove but spaced therefrom.

10. The piston of claim 1 wherein each strut of the plurality of struts extend radially from the sealing portion towards the plunger connection portion.

11. The piston of claim 10 wherein the sealing portion has an inner surface and the plurality of struts are equally spaced from one another around the inner surface of the sealing portion.

12. The piston of claim 11 wherein the crown portion has a cooling surface adjacent to the gallery and a portion of the struts extend to and terminate at the cooling surface of the crown portion.

13. The piston of claim 12 wherein another portion of the struts are connected to the cooling surface and extend to and terminate at the plunger connector portion.

14. The piston of claim 11 wherein each of the struts extend from the inner surface of the sealing portion and is connected to the plunger connection portion.

15. The piston of claim 14 wherein a compression height is defined by the distance between the end surface of the plunger connector portion and the combustion surface and the cylindrical surface of the sealing portion has a predetermined length that is less than the compression height.

16. The piston of claim 15 wherein each of the struts has a surface disposed thereon at a location on the side thereof opposed to the cooling surface and each of the struts is connected to the inner surface of the sealing portion at a location generally adjacent the end thereof spaced from the combustion surface and is connected to the plunger connection portion generally adjacent the end surface of the plunger connection portion.

17. The piston of claim 16 wherein the surface of each strut is angled with respect to the reference axis at an angle greater than fifty degrees.

18. The piston of claim 17 wherein the angle of the surface of each strut is angled with respect to the reference axis generally at an angle of fifty-five degrees.

19. The piston of claim 18 wherein the compression height is less than forty percent of the predetermined diameter of the cylindrical surface of the sealing portion.

20. The piston of claim 19 wherein the compression height is less than one-third of the predetermined diameter of the cylindrical surface of the sealing portion.

21. The piston of claim 20 wherein each of the struts is connected to the cooling surface of the crown portion.

22. The piston of claim 20 wherein each of the struts has a second surface opposing the first surface and a space is provided between the second surface and the cooling surface of the crown portion.

23. The piston of claim 20 wherein the piston is formed from a steel material and the skirt portion is formed from sheet metal and secured to the sealing portion on the end opposite to the crown portion.

24. The piston of claim 20 including a reentrant cavity defined therein adjacent to the gallery at the intersection of the inner surface of the sealing portion and the cooling surface of the crown portion.

25. The piston of claim 20 in combination with a free-piston engine having a cylinder combustion chamber for receipt of the piston, a plunger assembly connected to the piston on one end thereof and connected on the other end to a hydraulic fluid compression chamber.

26. The piston of claim 10 wherein the plurality of struts has a predefined total surface area and the predefined total surface area is at least one and one-half to two time the surface area of the combustion surface.

* * * * *

UNITED STATES PATENT AND TRADEMARK OFFICE

CERTIFICATE OF CORRECTION

PATENT NO. : 6,076,506
DATED : June 20, 2000
INVENTOR(S) : Willibald G. Berlinger It is certified that error appears in the above-identified patent and that said Letters Patent is hereby corrected as shown below:

Column 2,
Line 55, delete "compression" and insert -- combustion -- therefore.

Column 3,
Line 66, delete "skirt" and insert -- sealing -- therefore.

Column 4,
Lines 13, 19 and 24, delete "skirt" and insert -- sealing -- therefore.
Line 10, delete the element number "56" and insert -- 58 -- therefore.
Line 64, delete the element number "50", two occurrences, and insert in both occurrences, the element number -- 60 -- therefore.
Line 66, delete the element number "48" and insert -- 16 -- therefore.

Claims,
Claim 1, column 6,
Line 41, delete "portion".

Claim 4, column 6,
Line 53, delete "connector" and insert -- connection -- therefore.

Claim 12, column 7,
Line 19, insert -- plurality of -- before the work "struts".

Claim 13, column 7,
Line 22, insert -- plurality of -- before the word "struts".
Line 23, delete "connector" and insert -- connection -- therefore.

Claim 14, column 7,
Line 24, after "each" insert -- strut -- and before " struts" insert -- plurality of --.

Column 16, column 7,
Line 32, after "each" insert -- strut -- and before "struts" insert -- plurality of --.

UNITED STATES PATENT AND TRADEMARK OFFICE

CERTIFICATE OF CORRECTION

PATENT NO. : 6,076,506
DATED : June 20, 2000
INVENTOR(S) : Willibald G. Berlinger It is certified that error appears in the above-identified patent and that said Letters Patent is hereby corrected as shown below:

Claim 25, column 8,
Line 31, after "plunger" delete "assembly".

Signed and Sealed this

Thirteenth Day of November, 2001

*Attest:*

Nicholas P. Godici

NICHOLAS P. GODICI
*Acting Director of the United States Patent and Trademark Office*

*Attesting Officer*